United States Patent [19]

Noack et al.

[11] Patent Number: 4,522,370

[45] Date of Patent: Jun. 11, 1985

[54] VALVE

[75] Inventors: Timothy J. Noack, Lewisville, Tex.; Lester C. Rathie, Dartmouth, Canada

[73] Assignee: Otis Engineering Corporation, Carrollton, Tex.

[21] Appl. No.: 437,172

[22] Filed: Oct. 27, 1982

[51] Int. Cl.[3] ..... F16K 31/143

[52] U.S. Cl. ..... 251/63.5; 251/94; 166/323; 166/324

[58] Field of Search ..... 251/63.5, 63.6, 94, 251/95, 56; 166/321, 323, 324, 386, 319

[56] References Cited

U.S. PATENT DOCUMENTS

| | | | |
|---|---|---|---|
| 1,679,370 | 8/1928 | Nordstrom | 251/94 |
| 3,568,715 | 3/1971 | Taylor | 166/321 |
| 3,821,962 | 7/1974 | Mott | 166/323 |
| 3,830,297 | 8/1974 | Cockrell | 251/63.5 |
| 3,842,913 | 10/1974 | Mott | 166/323 |
| 3,941,141 | 3/1976 | Robert | 251/94 |
| 4,149,698 | 4/1979 | Deaton | 251/63.6 |
| 4,368,871 | 1/1983 | Young | 166/324 |

FOREIGN PATENT DOCUMENTS

| | | | |
|---|---|---|---|
| 1594714 | 8/1981 | United Kingdom | 166/323 |

*Primary Examiner*—Samuel Scott
*Assistant Examiner*—Noah Kamen
*Attorney, Agent, or Firm*—Vinson & Elkins

[57] ABSTRACT

A subsurface valve which functions as a lubricator valve and a retainer valve in response to changes in control pressure which may be pumped through to kill a well and which is provided with a lock means for locking the valve in closed position.

9 Claims, 12 Drawing Figures

VALVE

BACKGROUND OF THE INVENTION

This invention relates generally to valves useful in reservoir and well testing and other operations from a floating drilling or workover vessel. It relates specifically to a combination lubricator and retainer valve which may selectively prevent fluid flow in one or both directions in order to prevent inadvertent escape of fluids into the environment and to allow for a chamber within the test or work string for the introduction and running of various downhole tools.

Generally when it is desired to determine the well or reservoir potential of a well drilled in offshore waters from a floating drilling vessel, tubing is run from the vessel to the producing formation that requires testing. Surrounding this tubing from the drilling vessel to the sea floor is a device called a riser which aids in preventing inadvertent escape of formation or other fluids into the environment. Below the riser is a blowout preventer stack to prevent the flow of downhole fluids to the surface, if necessary. The lower end of the tubing is usually connected to various testing devices and the upper end is connected either to a flow diversion device which diverts the flow of formation fluids to certain surface test and storage equipment or is connected to a pressure containment device such as a wireline stuffing box which allows the introduction of wireline into the tubing while the tubing is pressurized within from formation fluids.

Typically, there is also connected to the tubing string a master valve generally referred to as a subsea test tree (SSTT). The subsea test tree is a remotely controlled device to prevent the flow of formation fluids to the environment in case the drilling vessel has to move from the well site in an emergency such as a severe storm. The tubing string above the SSTT may be unlatched from the top of the SSTT by an integral part of the SSTT, leaving the lower portion of the SSTT within the blowout preventer stack. The lower portion of the test string is supported by the SSTT which in turn is supported by a landing device within the wellhead.

When the upper test string of tubing is unlatched from the SSTT, the upper test tubing may contain pressurized formation fluids which could escape into the environment if not contained in some manner. In the past these fluids have been prevented from escaping by a retainer valve which would prevent pressure fluid from escaping.

Another device typically connected to the test string of tubing was a lubricator which would allow the introduction of a wireline tool string or other devices into the test string. If this lubricator section was placed above the drill floor of the drilling vessel, it often was quite a height above the normal personnel working surface and difficult to manipulate.

A lubricator valve was developed that could be placed below the drill floor at a preselected depth within the riser. This device contained a method of preventing the flow of formation fluids to the surface through the flow path of the tubing and once closed would allow the pressurized fluids above the lubricator valve to be bled off and the tubing string above the lubricator valve to be used for the introduction of tools into the tubing eliminating the awkward lubricator and tubing above the drill floor.

Both the above mentioned lubricator and retainer valve were remotely controlled from the drilling vessel by hydraulic pressure applied through hydraulic lines. As can be seen above, two different valves were used along with their associated operating equipment to perform the required functions. It is desirable to incorporate the two valves into one valve that will perform both functions. The present invention is a combination lubricator and retainer valve which is constructed to failsafe and to selectively prevent the flow of fluids in one or both directions, yet still allow, in an emergency situation, for "kill" fluids to be pumped through the valve to "kill" the well.

U.S. Pat. No. 4,197,879 discloses a lubricator valve similar to other such devices. This valve shows a rotating ball that does not move longitudinally and holds pressure from below. However, unlike the present invention which hydraulically fails in the closed position preventing upward fluid flow, the '879 valve will remain in either the open or closed position upon failure of its actuator system. Therefore, if it hydraulically fails in the open position, the valve remains in the open position and will not prevent the escape of fluids into the environment. The present invention may utilize positive control line pressure to remain open and upon loss of such control line pressure the valve will close.

U.S. Pat. No. 4,253,525 discloses a retainer valve that hydraulically fails in the open position allowing the passage of fluids by the valve and into the environment. The '525 valve will hold pressure from either direction if closed. However, once in the closed position, the valve will not allow "kill" fluids to be pumped through the valve.

SUMMARY OF THE INVENTION

The present invention which combines the functions of the lubricator and retainer valves selectively prevents flow in either one or both directions. It will, through a retainer lock mechanism, allow the valve to prevent fluid flow from above or allow "kill" fluid to be pumped through the valve.

It is an object of this invention to provide a new and improved valve that combines the functions of a lubricator and a retainer valve, fails safe, and permits "kill" fluid to be pumped by the valve.

Another object is to provide a combination lubricator and retainer valve in which the valve opening and closing system fails in valve closed position and a latch for locking the valve closed fails in the unlatched position.

Another object of this invention is to provide a combination lubricator and retainer valve that will selectively prevent the flow of fluids in one or both directions.

Another object of this invention is to provide a combination lubricator and retainer valve that will fail, upon loss of control line pressure, in the closed position preventing flow of fluids from below the valve, yet selectively allow, through a retainer lock means, "kill" fluids to be pumped through the valve into the formation below.

Another object of this invention is to provide a combination lubricator and retainer valve that will prevent fluid flow in one or both directions, and in an emergency situation when the normal closing force is not sufficient to close the valve, provide for positive pressure on the retainer lock control line allowing the retainer locking means to assist in forcing the valve to closed position.

Other objects and advantages will be apparent from the drawings, specification and the claims.

BRIEF DESCRIPTION OF DRAWINGS

In the drawings wherein like reference numerals show like parts and illustrative embodiments of the invention are shown.

DESCRIPTION OF PREFERRED EMBODIMENT

Figure 1:
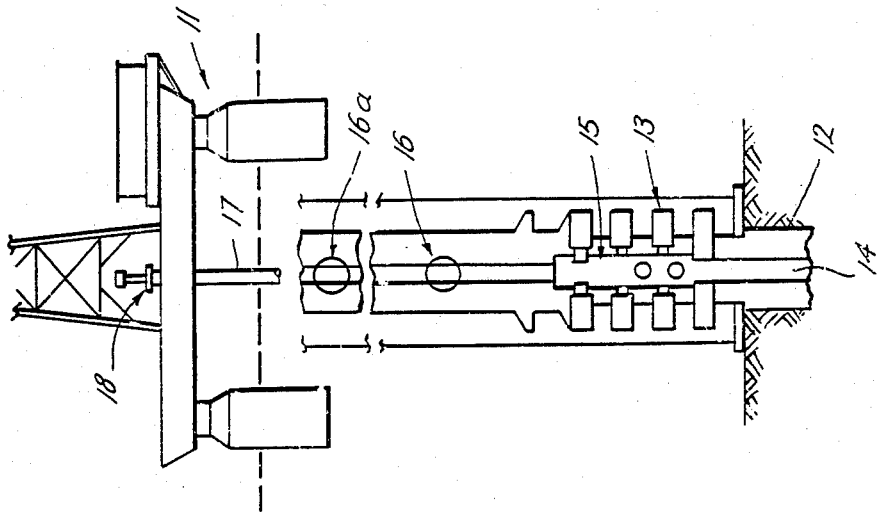
FIG. 1 is a schematic illustration of an offshore test system employing this invention.

In FIG. 1 the drill vessel indicated generally at 11 is testing production of well 12. As is conventional practice, the wellhead includes the blowout preventer stack 13 in which the tubing string 14 is supported. At the upper end of the tubing string the subsurface safety valve tree, indicated generally at 15, is positioned within the blowout preventer stack.

Immediately above the subsurface safety valve and immediately below the drilling floor, the lubricator-retainer valve of this invention is indicated generally at 16 and **16*a*, respectively. In conventional manner the test string 17 in which the lubricator-retainer valves are located, is provided at its upper end with a removable top or cap 18** or other type of upper lubricator valve mechanism to provide for lubricating tools into the string.

By manipulation of the cap 18 and the lubricator-retainer valves 16 and **16*a*, tools may be introduced into and withdrawn from the hole, as desired. Normal test production will be carried out through the tubing 14 and the upper string 17 in the conventional manner. When it is desired to remove the upper string 17, the latch which forms a part of the SSST 15 is released and the upper string may be removed leaving the lower portion of the SSST in place. At this time the lubricator-retainer valve 16 is closed and retains the fluid within the string 17 as the string 17 is raised into the drilling vessel 11**.

Also, both 16 and **16*a* may be used to seal from above to pressure test the integrity of the test string 17**.

Figure 2:
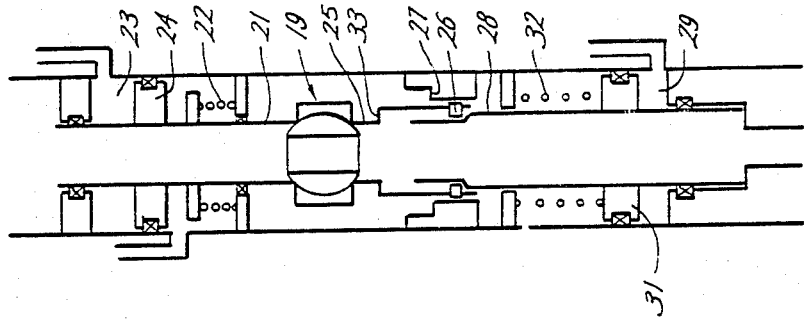

FIG. 2 illustrates the valve of this invention schematically. The valve includes a valve member which may take any form but is preferably the ball valve member indicated generally at 19 which is moved between open and closed position by reciprocation of the actuator 21. The actuator 21 is urged upwardly toward valve closing position by resilient means, such as the spring 22. The actuator is urged downwardly by pressure within the pressure chamber 23 effective on the upper face of piston 24. Thus, as in conventional subsurface safety valves, the valve 19 travels with the actuator 21 and is moved to the closed position shown in FIG. 3 by the spring 22 and downwardly to the open position shown in FIG. 2 by the force of pressure fluid within the chamber 23.

Figure 3:
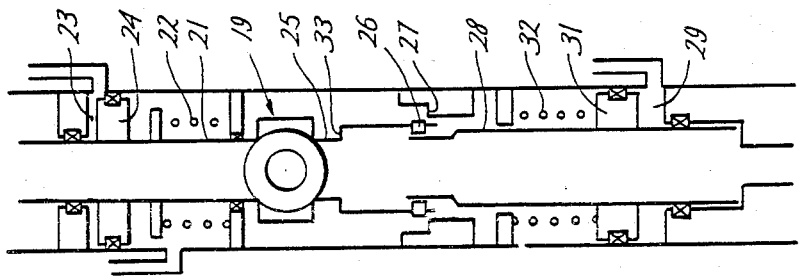

With the valve in closed position, as shown in FIG. 3, "kill" fluid can be introduced into the tubing and pumped down against the top of the ball valve. This pressure exerted downwardly on the ball valve will cause it to unseat and move towards open position in the conventional manner when for some reason the control pressure chamber 23 cannot be pressurized to move the valve to open position. Thus, in the event of loss of control pressure and an inability to pressurize the chamber 23, the spring 22 will be effective upon actuator 21 to move the valve 19 to closed position, as shown in FIG. 3. Introduction of "kill" fluid into the valve will be effective downwardly on the valve member and move the valve member away from its seat and rotate the valve toward open position to permit the introduction of "kill" fluid under emergency conditions when control pressure cannot be exerted upon the chamber 23.

In accordance with this invention a two-position mandrel 25 is provided. The mandrel may be separate from the actuator 21 and valve 19, if desired. Where a ball valve is utilized, it is preferably attached to the actuator 21 and is reciprocal therewith. In its up and locked position the mandrel supports and maintain the valve 19 in closed position. (See FIG. 4.)

Figure 4:
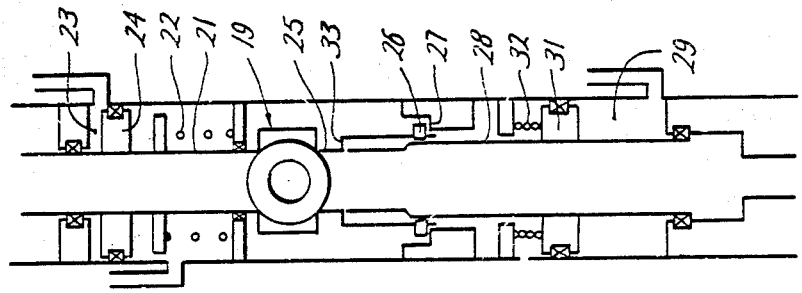
FIGS. 2, 3 and 4 are schematic illustrations of the combination lubricator-retainer valve of this invention showing the valve open in FIG. 2, closed in FIG. 3, and locked closed in FIG. 4.

A pressure responsive releasable latch means is provided for locking the mandrel 25 in a position to maintain the valve 19 in the closed position, as shown in FIG. 4.

The releasable latch means preferably includes lugs 26 carried in the mandrel 25 which are cooperable with a shoulder 27 in the housing to hold the mandrel 25 in its upper position where it prevents downward movement of the valve 19 and maintains it in its closed position.

The releasable latch means also includes the piston 28 which provides a lock-out member engaging the lugs 26 and extending them and holding them in engagement with the shoulder 27 when the prop-out piston is moved upwardly by pressure within the chamber 29 acting on piston 31 to position the prop-out piston 28 behind the lugs. When pressure is removed from the chamber 29 the resilient means, such as spring 32, returns the prop-out piston to its lower position, shown in FIGS. 2 and 3.

The mandrel 25 includes a downwardly facing shoulder 33 which is engaged by the upper end of the piston 28 when the piston is in its upper position. Thus, in emergency conditions the latching system may be utilized to assist in forcing the valve 19 to closed position. For instance, if in an emergency the valve is to be closed with a wireline extending through the valve member, pressure against the lock-out piston 28 may be utilized to assist in forcing the valve 19 to rotate to its closed position and in doing so sever the wireline. For this purpose the ball valve is constructed with a hardened cutting edge in the conventional manner. The valve may include a balance chamber below the piston 24, as will be explained hereinbelow, which balances the hydrostatic head of fluid in the control line in the conventional manner, and which may be pressurized to move the actuator upwardly to rotate the ball valve 19 and cut any wireline extending therethrough. Thus, both balance line pressure and the latch control pressure may be effective upon the ball 19 to urge it to closed position. A single source of pressure may pressurize both the balance chamber and the lock-out piston chamber and this pressure against the pistons 24 and 31 would be effective to rotate the valve 19 to closed position.

In normal operation the lubricator-retainer valve would be reciprocated between the FIG. 2 and FIG. 3 open and closed positions by increasing and decreasing pressure within the control pressure chamber 23. It will be noted that failure of the control line system results in movement of the valve to closed position in response to extension of spring 22 so that the valve will automatically act as a safety valve and prevent flow of fluid from the well. If desired, "kill" fluid may be pumped down the tubing to force the valve 19 from its seat to "kill" the well.

When it is desired to release the upper string 17 at the SSST, the high pressure is removed from the control chamber 23 and the latch chamber 29 is pressurized. This results in movement of the valve 19 to closed position by the spring 22 and movement of the lock-out piston 28 to its up position where it props-out the lugs 26 and prevents movement of the valve 19 to open position. The upper string 17 may now be drawn up into the vessel 11 without loss of fluid through the open end of the bottom of the string to thus avoid any possibility of contamination by loss of fluid from this string. This sequence is also used to pressure test the upper string 17.

The latch system is constructed to failsafe in a position where it will not interfere with normal operation of the valve 19. Thus, upon loss of pressure from chamber 29, the spring 32 moves the latch piston to its down position where it is not effective on the lubricator valve and the valve may be moved between its opened and closed position, as shown in FIGS. 2 and 3.

Thus, the valve is one in which in normal operation any hydraulic control failure moves the valve to closed position so that it may function as a SSSV, while still permitting "kill" fluid to be pumped by the valve. If hydraulic control failure occurs in the latch system, the latch fails in an out of the way or nonoperative position which will not interfere with operation of the valve 19 as a safety valve or with pumping "kill" fluids past the valve 19.

In FIGS. 5 and 6 a preferred form of lubricator-retainer valve is illustrated. While the valve is illustrated in cross-section, it will be appreciated that the ports for introducing the several fluids into the valve may be arranged on a common side so that the control lines may be in a single group extending up the tubing. Also, the trunions about which the valve 19 rotates are actually spaced from a diametric plane of the valve so that they will engage the valve member eccentrically to cause the valve member to rotate about the trunions in the conventional manner.

The valve housing is provided by the top sub 34, the body 35, the down stop 36, the packing sub 37, the spring housing 38, and the bottom sub 39.

The body has a flowway 41 which extends the entire length of the body.

A cooperative valve member and seat, indicated generally at 19, controls flow through the valve. The structure includes the rotatable ball member 42 which cooperates with the floating valve seat 43. The ball 42 rotates about eccentrically mounted trunions 44 and 45 to move the valve between the open and closed position with travel of the ball 42 longitudinally of the valve body.

Valve actuator means 21 are provided for moving the valve 19 between open and closed position. Valve actuator 21 is enlarged at 46 to receive the floating seat 43. The enlargement provides a shoulder 47 against which the seat 43 can abut. A suitable O-ring seal 48 between the actuator and the floating seat 43 seals therebetween. The actuator 21 is provided at its lower end with a plurality of collet fingers 49 which extend downwardly and surround the ball valve 42. The collet fingers have inturned flanges 51 at their lower extremity on which the lock ring 52 is supported. A wiper ring 53 is supported on the lock ring 52 and bears against the lower surface of the ball valve 42. Springs 54 carried by the wiper ring 53 urge the wiper ring against the ball to support it as it moves between open and closed position. If desired, pins 55 and 56 may be carried by the rings 53 and 52 and extend into the space between adjacent collet fingers to prevent rotation of these two rings. To avoid a fluid lock, the actuator 21 has vertical slots 57 in its lower end immediately above the collet fingers 49. Upward movement of the actuator 21 is arrested by the shoulder 58 in the body 35.

A suitable resilient means is provided to urge the actuator 21 up toward valve closing position. This may be provided by the spring means, indicated generally at 22, which may include the inner and outer springs 59 and 61 compressed between the upper end of the body 35 and a spring stop 62 carried on the actuator 21.

At its upper end the actuator 21 includes an extension sub **21*a* which carries the piston 24 and its associated packing, indicated generally at 63 and 64, to provide a pressure responsive member for reciprocating the actuator 21**.

A seal, indicated generally at 65 and 68, seals between the extension sub **21*a* and the top sub 34 and cooperates with the seals 63 and 64 to provide a control fluid chamber 66 which may be pressurized through the control line connector 67 to control reciprocation of the actuator arm. By pressuring up the chamber 23, the actuator 21 is driven downwardly to compress the spring means 22 and move the ball 42 to its open position, as shown in FIG. 6. When the pressure is removed from the chamber 23, the spring means 22 expands to move the actuator 21 upwardly and move the ball 42 to its closed position, shown in FIG. 5**.

A seal, indicated generally at 69 and 71, seals between the body 35 and the actuator 21. This seal confines flow of fluid to the bore through the actuator 21, prevents downhole pressure from being applied to the seals 63–64 of the actuator piston 24 which would inhibit pumping through the valve as it would apply an upward pressure to the piston, and seals the spring chamber 72 in which the spring means 22 is located. While not usually employed with a shallow installation, it is preferred to provide a balance for the hydrostatic head of fluid in the control line for operating the actuator when the installation is at a substantial depth to eliminate the effect of this hydrostatic pressure on operation of the valve. For this purpose, a balance line connector 73 connects the chamber 72 to a balance line extending to the drill vessel. By filling the balance line and the control line with the same fluid, the hydrostatic head exerted by each will balance out the other and the actuator piston will be controlled solely by the spring means 22 and the pressure applied in the control and balance line. Pressure may be applied in the balance line to assist in closing the ball valve 42, such as in cases where it must be closed with a wireline in place and additional upward force is needed to assist the ball valve in cutting the wireline in closing.

In accordance with this invention, a two-position mandrel is provided which is movable between a first position in which the valve member may be locked in a closed position and a second position in which the valve member is in open position. This mandrel may be provided in any desired manner, such as by the mandrel 25. In FIG. 5 it is shown in the position it occupies with the valve member in closed position, and in FIG. 6 the position it occupies with the valve member in open position.

Preferably, the mandrel 25 is carried by the actuator 21. For this purpose the mandrel has a plurality of closed end slots 74 in its end adjacent the ball valve 42 and suitable studs 75 to which access may be gained through the slots 74 extend through the holes 76 in the end of the mandrel and fasten to the lock ring 52 so that the mandrel 25 will reciprocate with the actuator 21. This connection between the ring 52 and the mandrel 25 provides a force transmitting connection between the ball valve member and the mandrel. If desired, the upper end of the mandrel 25 may be provided with an end-wise facing outer flange 77 which extends over the lower end of the collet fingers 49 to lock the fingers to the ring 52 and prevent their expanding when an upward force is applied to the ring through the collet fingers as, for instance, in utilizing high balance pressure to force the ball valve 42 to close against substantial resistance, such as when cutting a wireline.

In accordance with this invention, a releasable latching means is provided to latch the mandrel to the body with the ball valve member in closed position. To provide for substantial pressure differential across the ball valve 42 it is preferred that the mandrel 25 be latched to the body in such manner that when a downward force is exerted on the closed ball valve member 42, this force will be transmitted through the mandrel 25 directly to the valve body. For this purpose the body is provided with a bearing sleeve 78 which is supported on the upwardly facing shoulder 79 in the packing sub 37. To properly space out the bearing sleeve one or more shims 81 may be interposed between the bearing sleeve 78 and the packing sub shoulder 79. The upper end of the bearing sleeve 78 is provided with a bearing shoulder 82 and the mandrel 25 carries a plurality of lugs 83 in radially extending holes 84 in the mandrel 25. Preferably, the bearing shoulder 82 on the bearing ring 78 is upwardly and outwardly inclined, and the confronting shoulder on the lugs 83 is chamferred as at 85 for full engagement with the bearing shoulder 82. When the lugs are held in extended position, as shown in FIG. 5, force may be transmitted directly from the ball through the two rings 53 and 52, the mandrel 25, the lugs 83, and the bearing sleeve 78 to the body packing sub 37.

A means is provided for releasably latching the mandrel to the body by propping out the lugs 83 or permitting them to retract radially into a position within the inner bore of the bearing sleeve 78. For this purpose a locking piston 86 is provided having at an intermediate area a relatively larger diameter section 87 which when moved behind the lugs 83 props these lugs out into a position where they engage the bearing sleeve 78. At another area the locking piston 86 is provided with a relatively smaller diameter area 88 which when moved behind the lugs 83 permits them to radially retract so that they do not extend beyond the outer diameter of the mandrel and may move into the inner diameter of the sleeve 78, thus not interfering with reciprocation of the mandrel 25.

Preferably, the locking piston 86 is provided with a pressure responsive means which will reciprocate the locking piston and thus releasably latch the mandrel in its first position in which the ball valve 42 is latched in its closed position and is directly supported on the packing sub 37.

The pressure responsive member for the locking piston is provided by piston 31 carrying the seals, indicated generally at 89 and 91 on the lower extension prop-out piston sub 92 which forms a part of the prop-out piston 86. Seals 93 and 94 are provided between the bottom sub 39 and the piston extension 92 to form with the seals 89 and 91 a lock pressure chamber 95 to which fluid may be introduced under pressure to exert an upward force on the seal 91 and drive the locking piston 86 upwardly to the position shown in FIG. 5 to prop-out the lugs 83.

Seals, indicated generally at 96 and 97 between the locking piston and the packing sub 37, cooperate with the seals 89 and 91 carried on the lock-out piston sub extension 92 to form a spring chamber 98 therebetween. This spring chamber 98 carries therein the return springs 99 and 101 which are compressed between the spring ring 102 bearing against the lower end of the packing sub 37 and a spring carrier 103 on the locking piston 86. The spring means 99 and 101 exert a downward force on the lock-out piston and return it to its lower position shown in FIG. 6 when pressure is removed from the lock-out pressure chamber 95. Thus, upon hydraulic failure of the lock-out system the springs drive the lock-out piston downwardly and release the lugs 83 so that the lock-out system fails safe in a position where it does not interfere with normal operation of the ball valve member 42.

Preferably, the chamber 98 is ported to the exterior, as at 104, so that ambient pressure is exerted downwardly on the piston 31. This will normally be the pressure of the hydrostatic head of column of fluid above the valve which acts as a balance for the hydrostatic head of fluid on the line from the surface to the lock pressure chamber 95 and thus the lock piston 86 is reciprocated by the action of the springs 99 and 101 and the pressure within the lock pressure chamber 95 and the springs do not have to overcome the hydrostatic head of fluid in the line leading to the lock pressure chamber 95.

Figures 5A, 6A:
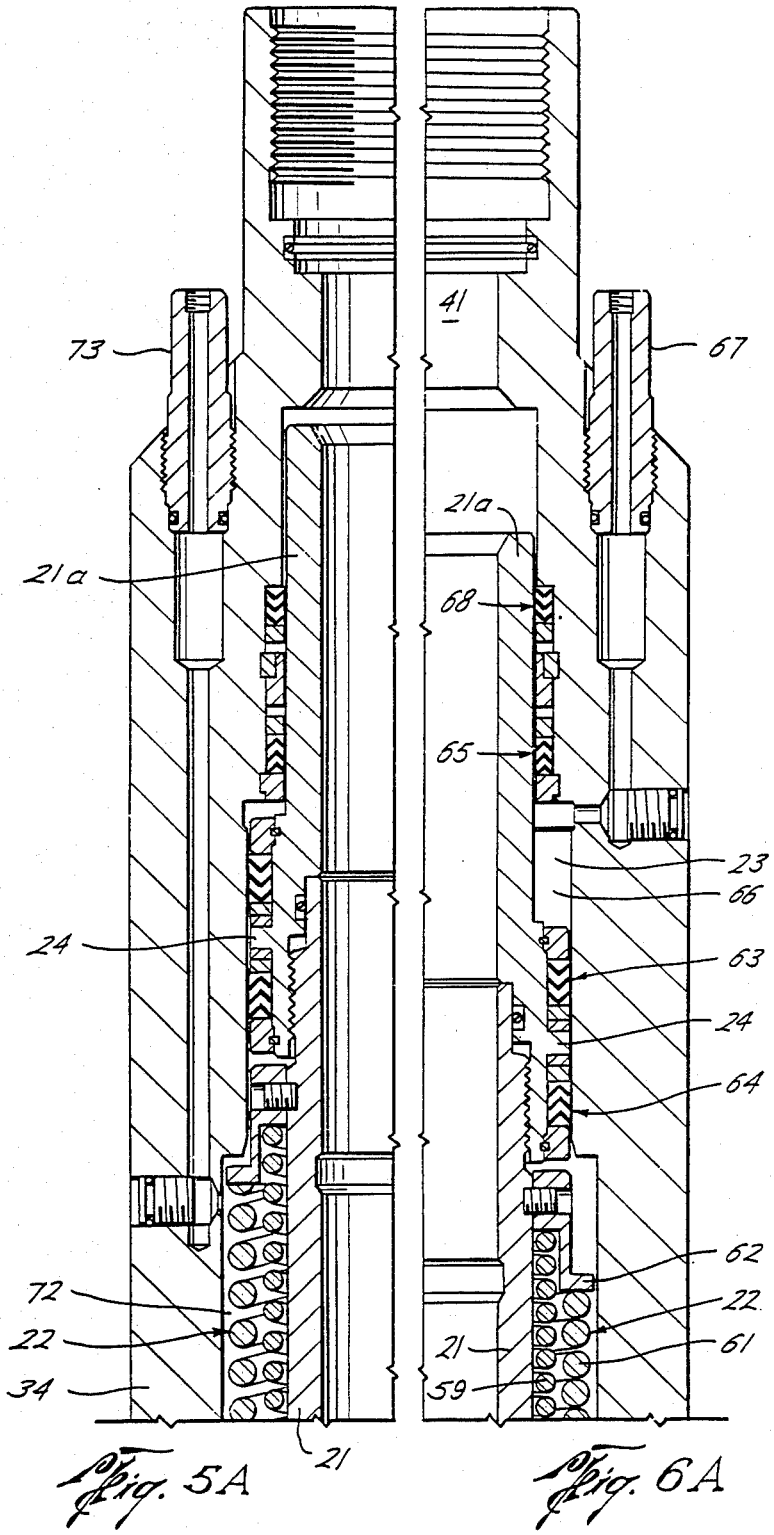
FIGS. 5A through 5D are continuation views in quarter-section illustrating a valve constructed in accordance with this invention with the valve in locked closed position.
FIGS. 6A through 6D are views similar to FIGS. 5A through 5D with the valve illustrated in open position.
Figures 5B, 6B:
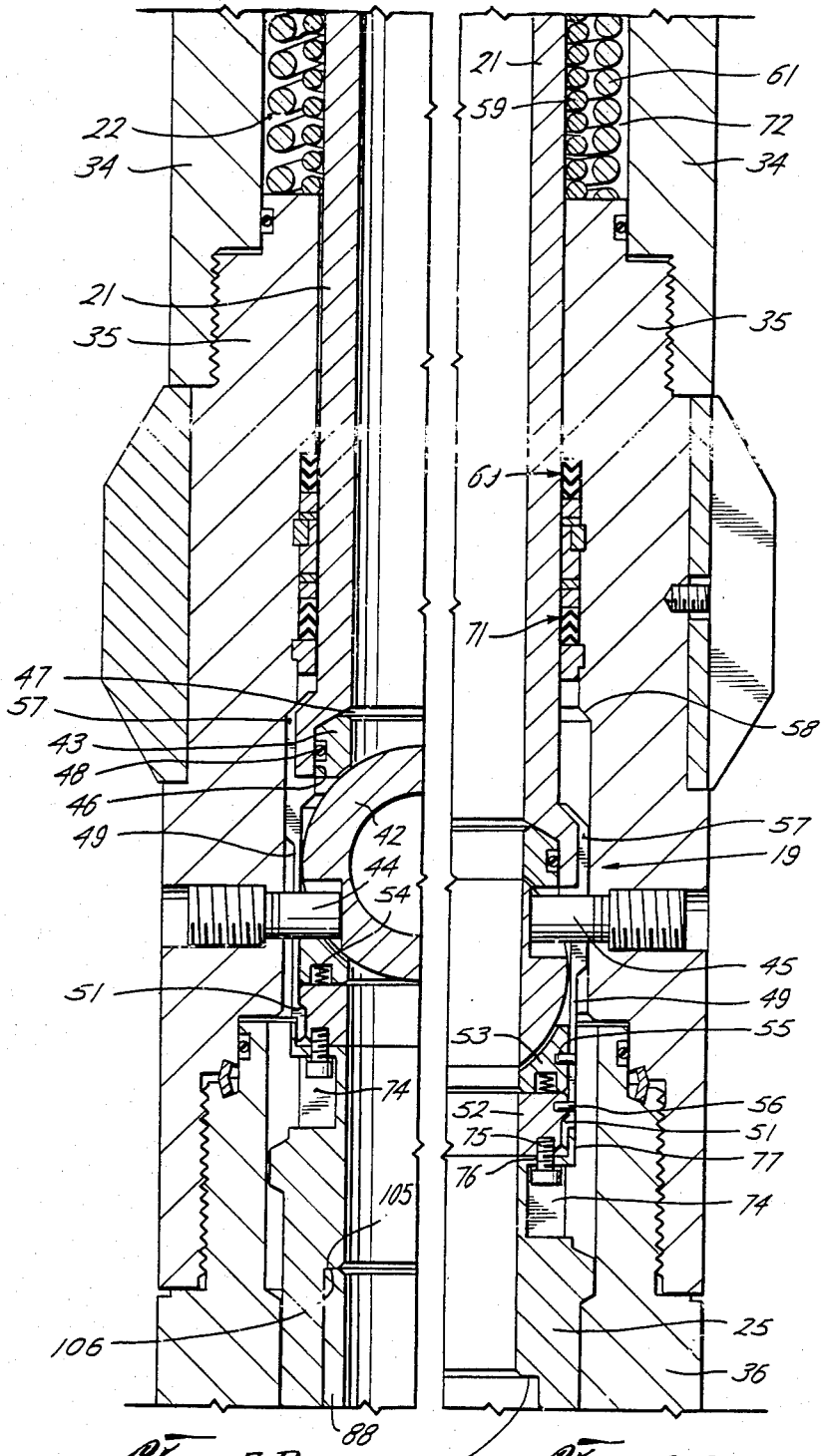
Figure 5C:
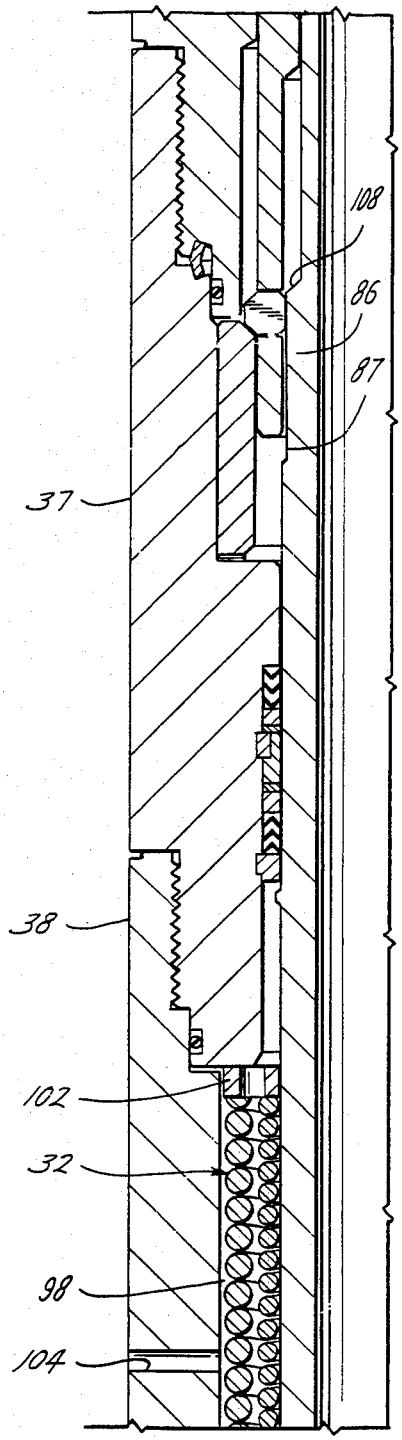

To provide assurance that the ball valve is in its closed position when the lock piston is up and supported on the bearing sleeve 78, the upper end 105 of the locking piston 86 abuts a downwardly facing shoulder 106 on the mandrel 25 when the locking piston 86 is moved to its uppermost position, as shown in FIG. 5B. This feature permits the upward movement of the locking piston 86 to exert a force on the mandrel 25 which is transmitted to the ball valve member 42 to drive the ball valve member to its closed position. Thus, pressurizing the lock fluid chamber 95 to drive the mandrel 25 upwardly will assist in forcing the ball 42 to its closed position when an obstruction is present, such as a wireline which must be cut by the ball 42.

Preferably, the balance pressure connector 73 and the lock pressure connector 107 which leads to the lock pressure chamber 95 are interconnected so that applying pressure to a single line at the surface will result in simultaneous increase of the balance pressure in balance chamber 72 and the lock pressure in the lock pressure chamber 95 and this pressure is applied to both the actuator piston 24 and the lock piston 31 to drive the ball valve to its closed position and insure that the ball will close even though obstructed and to maintain the ball in its closed position when the lubricator-retainer valve and the upper string is released from the SSST to retain the fluid in the upper string and prevent its contamination of the surrounding area.

Figure 6C:
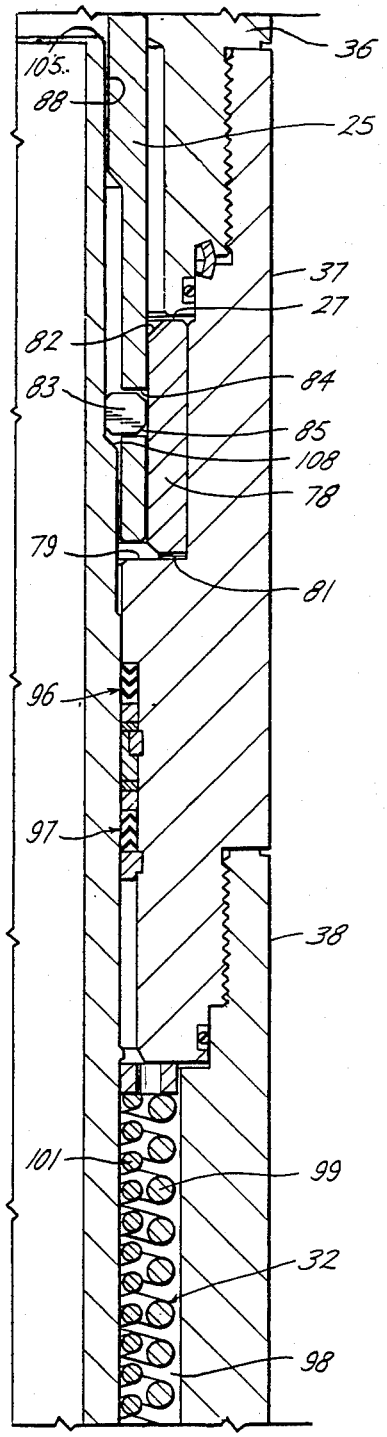
Figures 5D, 6D:
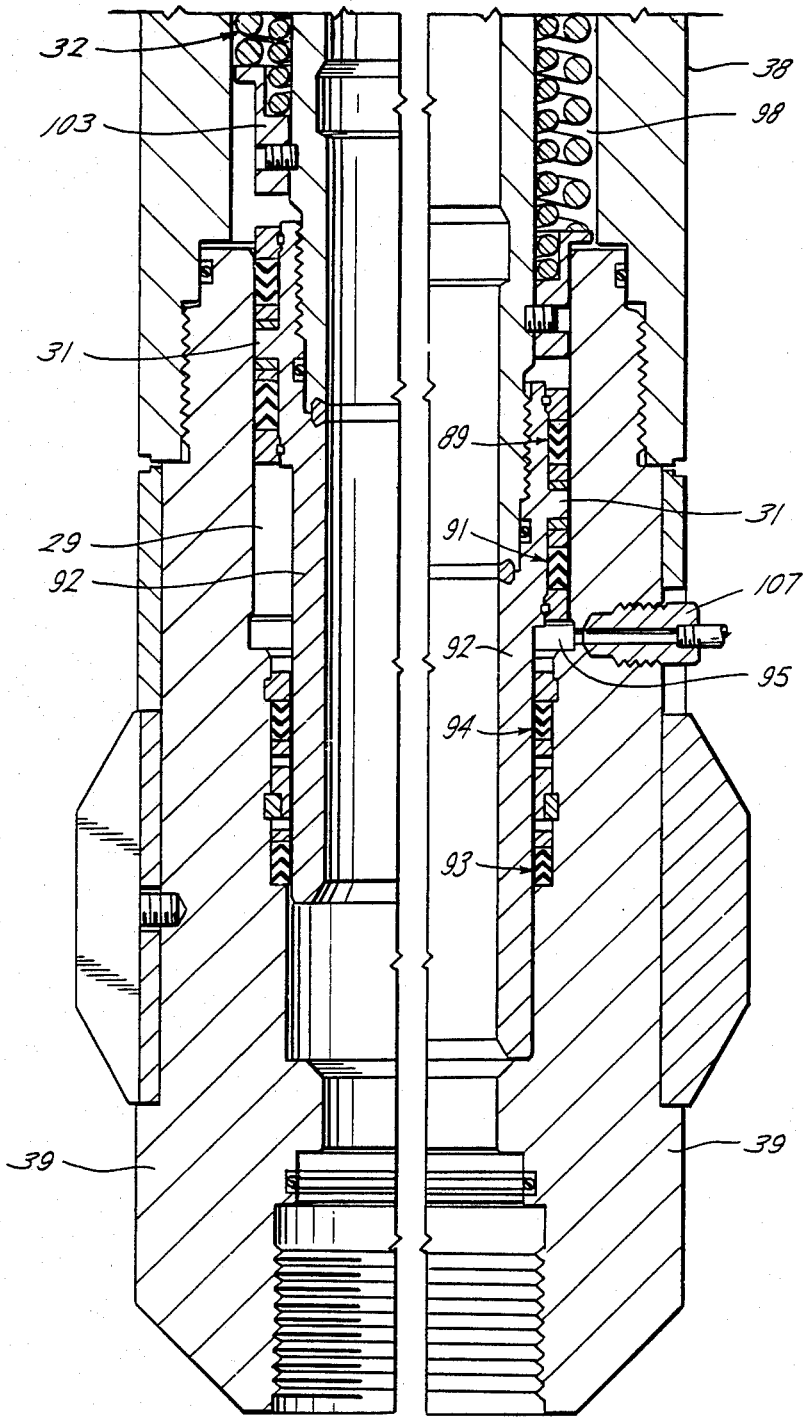

While the mandrel 25 is shown carried by the actuator 21, it will be apparent that this attachment is not necessary and the mandrel 25 may carry out its function without being carried by the actuator 21. The different diameter portions of the exterior of the locking piston at 87 and 88 provide therebetween a shoulder 108. This shoulder is spaced a short distance from the lugs 83 when the locking piston is in its full down position as shown in FIG. 6C. If the mandrel 25 not be connected to the actuator 21, the upward movement of the locking piston 86 will cause the shoulder 108 to engage the lugs and drive the lugs and the mandrel 25 upwardly until the lugs are above the bearing shoulder 82. Then the piston shoulder 108, being an outwardly and downwardly extending chamfer, will drive the lugs outwardly and permit the locking piston 86 to move upwardly to the position shown in FIG. 5 in which the lugs are propped-out. When the locking piston is moved to its down release position the prop-out surface 87 is below the lugs, as shown in FIG. 6C, and downward movement of the actuator 25 through the abutting engagement of the ring 52 carried by the downwardly extending collet fingers of the actuator will abut the upper end of the mandrel 25 and force it to its down position, as shown in FIG. 6. A flange such as flange 77 would be provided to entrap the collet fingers.

In operation the lubricator-retainer valve is made up at either (or both) the lower end or upper ends of the string 17 extending downward from the drill vessel to the SSST 15 and is connected thereto by a suitable connector, not shown. Reciprocation of the actuator 21 will open and close the ball valve in the conventional manner to permit the valve to act as a lubricator valve and in association with the closure 18 on the drill vessel permit lubricating in and out of the string any desired equipment to be utilized during testing. During these operations the prop-out locking piston 86 will normally remain in its lower position, as shown in FIG. 6, and have no influence on the valve. If for any reason there is a failure in the hydraulic control system for the actuator 21, the ball valve 42 will fail in closed position and act as a safety valve. If, however, the ball valve is in closed position and cannot be opened by control pressure and it is desired to pump "kill" fluid into the well, such may be done by pumping fluid down through the flowway 41 to exert a pressure on the top of the closed ball 42. As the ball is a travelling ball and rotates about the eccentric trunnions 44 and 45, this downward pressure will force the ball valve downwardly causing it to rotate and open to permit "kill" fluid to flow past the ball valve and into the well below.

When the string 17 is released at the SSST, the lubricator-retainer valve acts as a retainer valve. In this instance the lock fluid pressure chamber 95 is pressurized to drive the mandrel 25 upwardly and lock out lugs 83 with piston 86. Simultaneously the control pressure chamber 23 is depressurized so as to not interfere with this upward movement. If the balance chamber 72 and the lock pressure chamber 95 are interconnected or are both pressurized at the same time, they will both function to drive the actuator 21 and the mandrel 25 upwardly to the position shown in FIG. 5 where the ball valve 42 is in its full closed position. Then the lubricator-retainer valve is disconnected at the SSST and fluid above the ball valve will be contained therein, even though under substantial pressure. The pressure within the string above the ball valve is acting downwardly on the ball valve 42, but the ball valve 42 cannot move downwardly as it is supported through the mandrel 25 and the lugs 83 on the bearing sleeve 75. The downwardly acting pressure will be effective on the floating valve seat 43 to drive it firmly into engagement with the ball valve 42 and thus the pressure fluid within the string 17 above the ball valve will be retained therein and not escape from the string 17.

The force of pressure necessary to reciprocate the actuator 21 and the locking piston 86 when the ball valve is not under a substantial differential is much less than the mechanical locking force needed to hold the ball valve closed under a full design differential in either direction and the lubricator-retainer valve may be designed to operate under these lower control pressures while providing for a valve that may be pumped through, and will failsafe, and will remain closed with the ball supported directly on the body through members in compression.

While the invention is illustrated with a ball valve, it is apparent that it may be applied to other types of valves.

The foregoing disclosure and description of the invention is illustrative and explanatory thereof and various changes in the size, shape and materials, as well as in the details of the illustrated construction, may be made within the scope of the appended claims without departing from the spirit of the invention.

What is claimed is:

1. A lubricator-retainer valve comprising, a body having a flowway therethrough, a cooperative valve member and seat controlling flow through the flowway, said valve member movable along said flowway, means for moving said valve member between open and closed positions including a first pressure responsive member exposed to pressure fluid from a control line connector, a two-position mandrel means movable between a first position in which the valve member is in closed position and a second position in which the valve member is in open position, said mandrel means engaging and preventing movement of said valve member from closed to open position when in said first position, and pressure responsive latch means including a second pressure responsive member exposed to a second pressure fluid from a lock connector releasably latching the mandrel means to said housing in said first position in response to pressure applied to said second pressure responsive member, said mandrel means arranged such that when latched to said housing any force applied to move said valve member toward open position places said mandrel means in compression.

2. The lubricator-retainer valve of claim 1 wherein said mandrel means and pressure responsive latch means are provided by a shoulder in said body, an annular mandrel, lugs carried by said mandrel, a locking piston telescoped in said mandrel and having a reduced outer diameter portion to permit retracting of said lugs and a larger diameter portion to expand said lugs into engagement with said shoulder, resilient means urging said piston to position said reduced diameter portion in register with said lugs, and pressure responsive means carried by said piston and when pressurized moving said piston to a position where said larger diameter portion engages said lugs and holds them in extended position.

3. The lubricator-retainer valve of claim 2 wherein said piston is engageable with said mandrel and moves the mandrel to said first position in response to pressurizing of said pressure responsive means.

4. A lubricator-retainer valve comprising: a body having a flowway therethrough; a valve actuator in sliding sealing engagement with said body; resilient means urging said actuator toward a first position; a piston on said actuator in sliding sealing engagement with said body and providing part of a control fluid chamber exposed to pressure fluid from a control line connector which when pressurized urges said actuator to a second position; a floating valve seat carried by said actuator; a traveling ball valve member carried by said actuator and cooperable with said seat to control flow through said flowway; trunions carried by said body and eccentrically engaging said ball valve member to rotate the ball valve member between open and closed position as said actuator moves between said first and second position; a mandrel carried by said actuator below said ball valve member and in the path of travel of the ball valve member when traveling from closed to open position; force transmitting means between the ball valve member and mandrel; means releasably latching said mandrel to said body with the ball valve member in closed position; and pressure responsive means exposed to a second pressure fluid from a lock pressure connector for operating said releasable latching means.

5. The lubricator-retainer valve of claim 4 wherein said releasable latching means comprises a shoulder in said body, lugs carried by said mandrel, a locking piston telescoped in said mandrel and having a reduced outer diameter portion to permit retracting of said lugs and a larger diameter portion to expand said lugs into engagement with said shoulder, resilient means urging said piston to position said reduced diameter portion in register with said lugs, and pressure responsive means carried by said piston and when pressurized moving said piston to a position where said larger diameter portion engages said lugs and holds them in extended position.

6. The lubricator-retainer valve of claim 4 wherein said piston is engageable with said mandrel and moves the mandrel with the actuator as the actuator moves between said first and second positions.

7. The lubricator-retainer valve of claim 4 wherein said force transmitting means includes wiper means.

8. The lubricator-retainer valve of claim 1, 2, 3, 4, 5, 6 or 7 wherein said means for moving said valve member between open and closed position includes a balance chamber, and said balance chamber and said pressure responsive means are exposed to the same fluid pressure.

9. The lubricator-retainer valve of claim 1, 2, 3, 4, 5, 6 or 7 wherein failure of the means for moving the valve member between open and closed positions results in the valve member failing in the closed position and wherein failure of the pressure responsive means for the latch means results in the latch means failing in the unlatched position so that the closed valve member functions as a safety valve while permitting "kill" fluid to be pumped past the valve member.

* * * * *